United States Patent [19]

Fernandez

[11] Patent Number: 4,949,913

[45] Date of Patent: Aug. 21, 1990

[54] YARN CARRIER WITH ANTI-NESTING RIB

[75] Inventor: Israel Fernandez, Gastonia, N.C.

[73] Assignee: Conitex, Inc., Gastonia, N.C.

[21] Appl. No.: 351,729

[22] Filed: May 15, 1989

[51] Int. Cl.[5] ..... B65H 75/10

[52] U.S. Cl. ..... 242/118.3; 242/118.32

[58] Field of Search ..... 242/118.3, 118.31, 118.32, 242/118.1

[56] References Cited

U.S. PATENT DOCUMENTS

| | | | |
|---|---|---|---|
| 3,033,489 | 5/1962 | Morris | 242/118.32 |
| 3,138,345 | 6/1964 | Luber | 242/118.3 X |
| 3,141,631 | 7/1964 | Krebs | 242/118.3 |
| 3,361,381 | 1/1968 | Livingstone | 242/118.3 |
| 3,675,871 | 7/1972 | Heyden | 242/118.3 |
| 3,900,168 | 8/1975 | Hamilton | 242/118.32 |

FOREIGN PATENT DOCUMENTS

| | | | |
|---|---|---|---|
| 540715 | 9/1955 | Belgium | 242/118.3 |
| 2425420 | 12/1975 | Fed. Rep. of Germany | 242/118.3 |
| 3643819 | 6/1988 | Fed. Rep. of Germany | 242/118.3 |
| 2200837 | 4/1974 | France | 242/118.3 |
| 588406 | 5/1977 | Switzerland | 242/118.3 |

*Primary Examiner*—Stanley N. Gilreath

*Attorney, Agent, or Firm*—W. Thad Adams, III

[57] ABSTRACT

A frusto-conical yarn carrier of the type characterized by having a relatively small diameter end, a relatively large diameter end, an outer wall and a smooth, uninterrupted inner wall parallel to the outer wall whereby a plurality of like yarn carriers can be nested together for storage and shipment. The improvement comprises a projection such as an annular rib on one of the inner or outer wall of the cone for contacting the other of the inner or outer wall of a like yarn carrier into which the yarn carrier is nested and creating a non-parallel relationship between the adjacent walls for reducing surface contact between adjacent yarn carriers and thereby permitting easier separation from nesting relationship.

6 Claims, 2 Drawing Sheets

YARN CARRIER WITH ANTI-NESTING RIB

TECHNICAL FIELD AND BACKGROUND OF THE INVENTION

This invention relates to a yarn carrier with a rib which prevents a nested plurality of carriers from being locked together so tightly that separation is difficult. The invention is directed generally towards yarn carriers which are frusto-conical in shape and which have smooth, uninterrupted inner walls. Such yarn carriers are usually referred to as cones in the textile industry and are usually made of compressed, impregnated paper fiber. These cones are typically nested for shipment and storage to save space and to keep as much of the surface of the cones as possible covered and therefore clean.

A long length of nested cones is referred to as a "stick", and forms a useful way in which to store and transport cones. However, the cones, whether paper or plastic, have sufficient compressibility so that if the cones are nested together too tightly, it is often almost impossible to separate them without damage. This results because the inner and outer walls are substantially parallel along their entire length. Since the inner and outer walls are usually smooth and uninterrupted, a relatively large surface area of frictional contact exists.

The frictional characteristics of the cones surfaces are very carefully controlled so that the cones will properly seat on and rotate with the chucks on which they are mounted, and so yarn will properly wind onto and not slough off of the outer surface. For these reasons, alteration of the frictional characteristics of the inner and outer wall surfaces is impractical.

So far as is known, no prior solution to this problem exists except, perhaps, exercising care not to nest the cones too tightly to begin with. This is a very unsatisfactory solution. The invention disclosed in this application solves the problem in a very simple, inexpensive and almost foolproof manner.

SUMMARY OF THE INVENTION

Therefore, it is an object of the invention to provide a textile yarn carrier which can be nested for shipment or storage, and easily separated when needed.

It is another object of the invention to provide a textile yarn carrier which can be nested yet easily separated without interfering with the frictional characteristics of the inner and outer wall surfaces.

It is another object of the invention to provide a textile yarn carrier which can be nested yet easily separated without interfering with the overall surface characteristics of the inner and outer wall surfaces.

These and other objects of the present invention are achieved in the preferred embodiments disclosed below by providing in a frusto-conical yarn carrier of the type characterized by having a relatively small diameter end, a relatively large diameter end, an outer wall and a smooth, uninterrupted inner wall parallel to the outer wall whereby a plurality of like yarn carriers can be nested together for storage and shipment, the improvement comprising a projection from one of the inner or outer wall of the cone for contacting the other of the inner or outer wall of a like yarn carrier into which the yarn carrier is nested and creating a nonparallel relationship between the adjacent walls for reducing surface contact between adjacent yarn carriers and thereby permitting easier separation from nesting relationship.

According to a preferred embodiment of the invention, a frusto-conical yarn carrier of the type characterized by having a relatively small diameter end, a relatively large diameter end, an outer wall and a smooth, uninterrupted inner wall parallel to the outer wall whereby a plurality of like yarn carriers can be nested together for storage and shipment is provided. The improvement according to the invention comprises a projection from the inner wall of the cone for contacting the outer wall of a like yarn carrier into which the yarn carrier is nested and creating a nonparallel relationship between the adjacent walls for reducing surface contact between adjacent cones and thereby permitting easier separation. According to one preferred embodiment of the invention, the projection comprises an annular rib.

According to another preferred embodiment of the invention, the annular rib is integrally formed with the yarn carrier.

According to yet another preferred embodiment of the invention, the annular rib is positioned nearer the large diameter end than the small diameter end of the yarn carrier.

Preferably, the invention includes a complementary annular groove on the other of the inner or outer wall of the yarn carrier in axial and radial alignment with the annular rib.

Preferably, the annular rib is positioned in relation to the relatively large diameter end of the yarn carrier by a distance less than the distance between the large diameter ends of two like yarn carriers when nested.

According to one preferred embodiment of the invention, the yarn carrier is fabricated from compressed paper fiber and comprises a textile winding cone.

According to yet another preferred embodiment of the invention, the projection in the form of an annular rib is separately formed and then attached to the wall of the yarn carrier.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
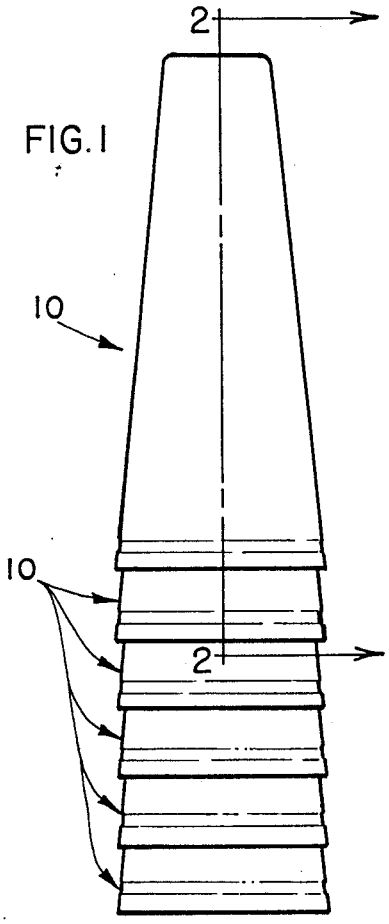
FIG. 1 is a side elevation view of a plurality of nested textile cones.

Referring now specifically to the drawings, a plurality of nested yarn carriers or cones according to the present invention is illustrated in FIG. 1 and each shown generally at reference numeral 10. Yarn carriers of the type described below are generally referred to as cones and this terminology will therefore be used below. However, it is used in the general, descriptive sense and not in a limiting sense. The invention has application for any type of yarn carrier having a generally frusto-conical shape and a smooth, generally uninterrupted inner wall so that the carriers can be nested.

The particular cones shown in the FIGS. are 5 degree, 57 minute fiber cones.

Figure 2:
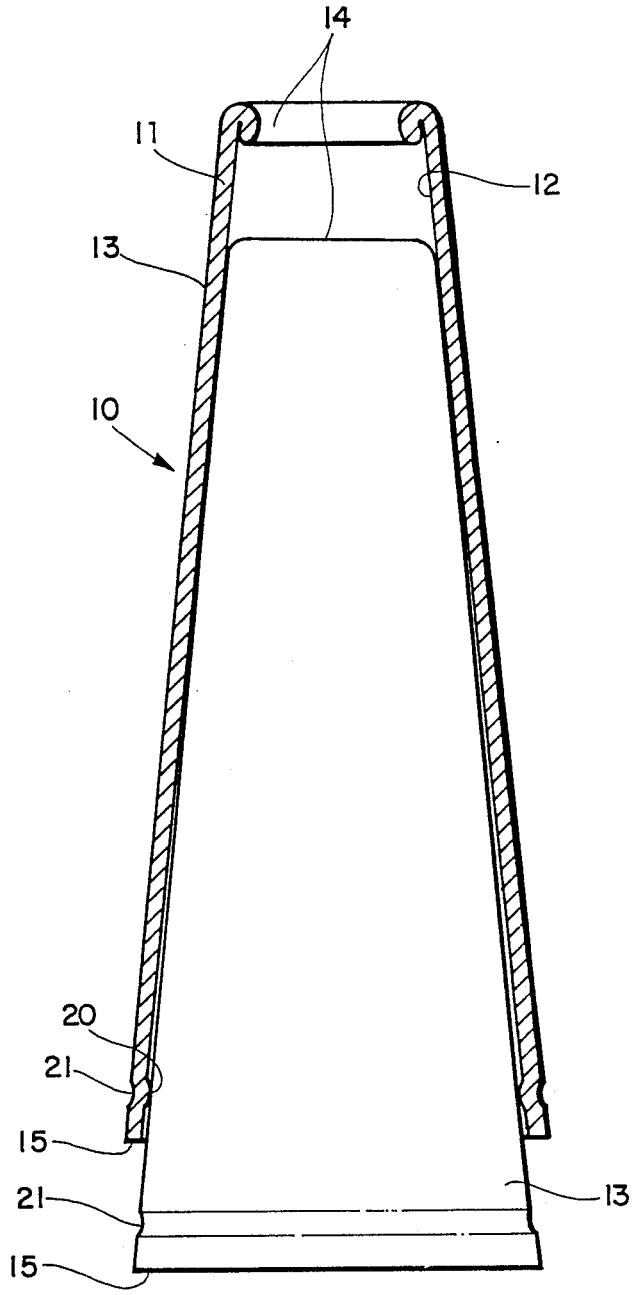
FIG. 2 is a vertical cross-sectional view taken substantially along lines 2—2 of FIG. 1.

As is best shown in FIG. 2, each cone 10 comprises an elongate, frusto-conical body 11 defining an inner wall 12 and a parallel outer wall 13. The shape of cone 10 defines a relatively small diameter end 14 and an opposed relatively large diameter end 15 having an inside diameter of 67.5 mm.

Figure 3:
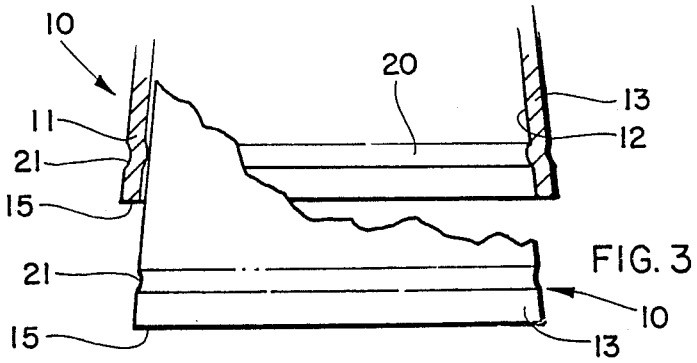
FIG. 3 is a is a fragmentary view of the large diameter ends of the cones shown in FIG. 2.

In accordance with one embodiment of the invention and as is shown in FIGS. 2 and 3, an annular rib 20 is integrally formed in the body 11 of cone 10 and projects outwardly from inner wall 12 adjacent the large diameter end 15. Preferably, rib 20 is formed by a rolling process so that no material is added to cone 10, but is simply displaced inwardly so that a complementary groove 21 is formed on outer wall 13 opposite rib 20. The exact location of the rib 20 is not critical. However, in the embodiment shown in FIGS. 2 and 3, it should be spaced from the large diameter end 15 of cone 10 by a distance less than the distance between the ends 15 of adjacent cones 10 when they are nested. This prevents interference between the rib 20 of a cone 10 and the groove 21 of the inner adjacent cone 10.

As is best shown in FIGS. 2 and 3, rib 20 interferes the nesting of the otherWise parallel inner and outer walls 12 and 13 of adjacent cones 10, so that they are not longer parallel. Instead, inner wall 12 of the outer cone 10 as shown in FIG. 1 diverges from the outer wall 13 of the inner cone 10 towards the large diameter end 15. As a result, frictional engagement between the adjacent walls is greatly reduced.

Of course, two adjacent cones 10 can be forced together so tightly that the rib 20 is compressed and the walls along most of the length of the cones 10 touch. However, the presence of the rib 20 nevertheless greatly reduces the degree of frictional engagement and therefore permits the cones 10 to be much more easily separated.

Figure 4:
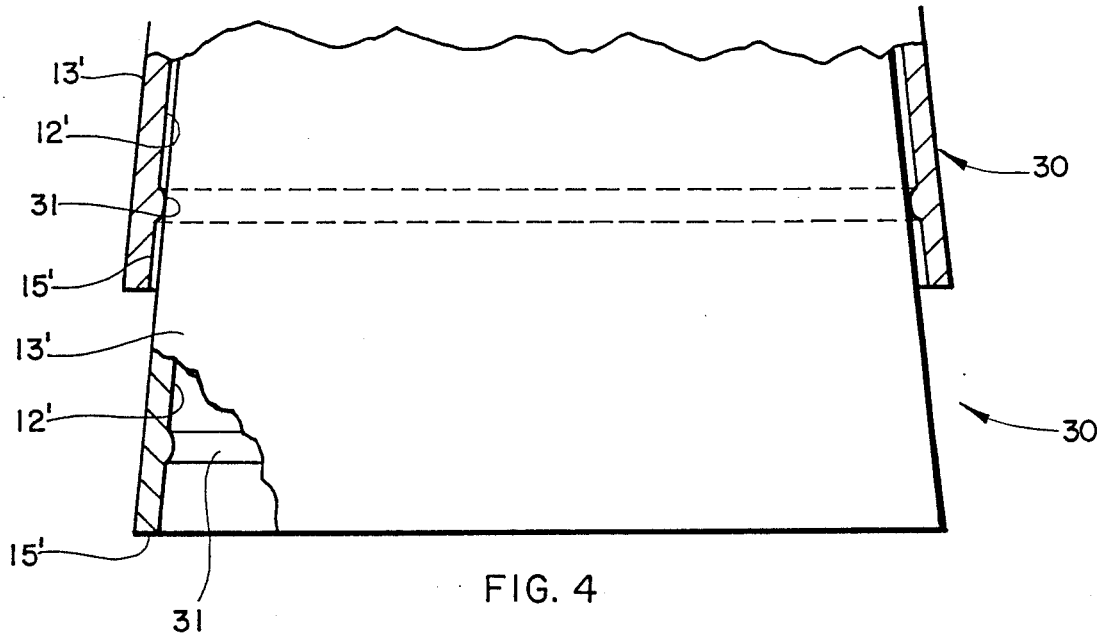
FIG. 4 is an enlarged, fragmentary view of a second embodiment of the invention.

Another embodiment of the invention is shown in FIG. 4. A cone 30 is constructed substantially in the same manner as cone 10 and therefore like elements are referred to with like reference numerals in prime notation. An annular rib 31 is molded or otherwise formed into the inner wall 12' without interfering with outer wall 13'. Therefore, no groove or other external evidence of the rib 31 is present on outer wall 13'. Otherwise, ribs 20 and 31 in FIGS. 3 and 4, respectively, are substantially the same.

Figure 5:
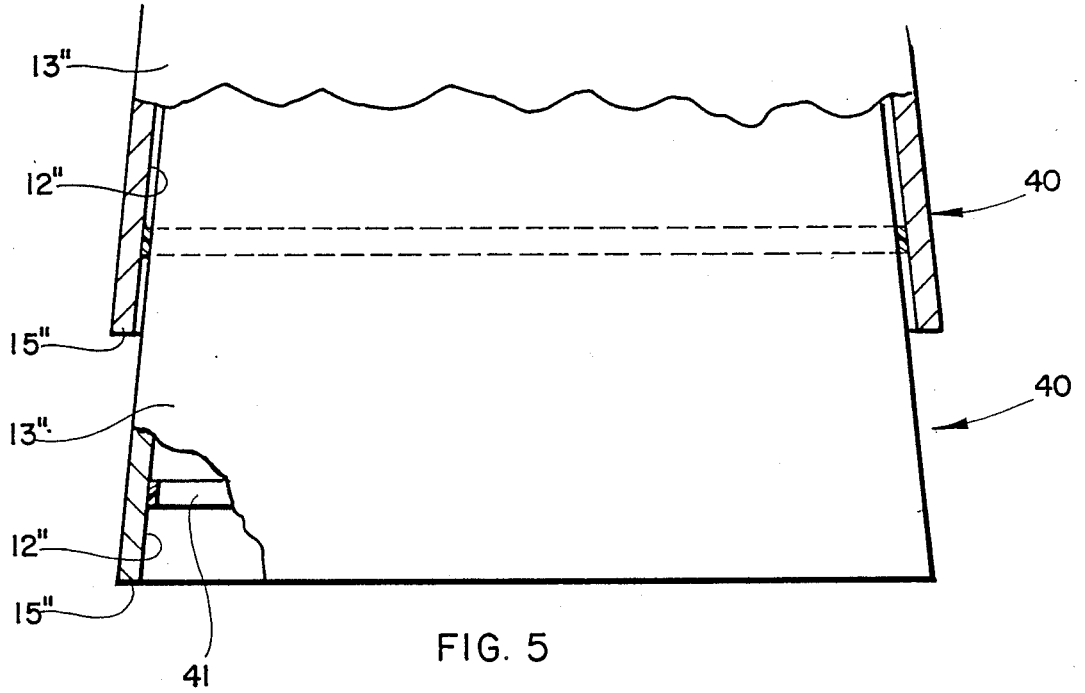
FIG. 5 is an enlarged, fragmentary view of a third embodiment of the invention.

A further embodiment of the invention is shown in FIG. 5, where again like reference numerals in double prime notation identify elements in common with the embodiments shown in FIGS. 3 and 4. A cone 40 includes a rib 41 which comprises a separate structure applied to the inner wall 12" of an otherwise conventional cone. Rib 41 may comprise a small ring of rubber, paper, plastic or some other suitable material adhered to inner wall 12" with a suitable adhesive. Alternatively, rib 41 may comprise an annular bead of a curable or hardenable material such as latex, rubber cement or some other extrudable material which forms an annular raised surface when applied.

Preferably, ribs 20, 31 and 41 each comprise a single, continuous projection. However, interruptions in the rib could be provided as well as a plurality of identical or differently shaped or sized ribs, if desire.

Ribs 20, 31 and 41 are preferably spaced about 7 mm above the large diameter end of respective cones 10, 30 and 40, are approximately 3 mm wide at the base and project approximately 0.5 mm outwardly from the adjacent inner wall. The preferred profile is that of a slightly flattened semi-circle, as is that of the groove 21.

A yarn carrier is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. In a frusto-conical paper yarn carrier of the type characterized by having a relatively small diameter end, a relatively large diameter end, an outer wall and a smooth, uninterrupted inner wall parallel to the outer wall whereby a plurality of like yarn carriers can be nested together for storage and shipment, the improvement comprising a narrow annular rib having a width of approximately 3 millimeters and a height of approximately 1 millimeter projecting from the inner wall of the carrier in spaced-apart relation from the relatively large diameter end thereof but nearer the larger diameter end than the smaller diameter end thereof for contacting the outer wall of a like yarn carrier into which the yarn carrier is nested for reducing surface contact between adjacent yarn carriers and thereby permitting easier separation from nesting relationship.

2. In a yarn carrier according to claim 1, wherein the annular rib is integrally formed with the yarn carrier.

3. In a yarn carrier according to claim 1, and including a complementary annular groove on the other of the inner or outer wall of the yarn carrier in axial and radial alignment with the annular rib.

4. In a yarn carrier according to claim 1, wherein the annular rib is positioned in relation to the relatively large diameter end of the yarn carrier by a distance less than the distance between the large diameter ends of two like yarn carriers when nested.

5. In a yarn carrier according to claim 1, wherein the yarn carrier is fabricated from compressed paper fiber.

6. In a yarn carrier according to claim 5, wherein the yarn carrier comprises a textile winding cone.

* * * * *